US005702074A

United States Patent [19]

Paterick-Smith et al.

[11] Patent Number: 5,702,074

[45] Date of Patent: Dec. 30, 1997

[54] RAILWAY SWITCH HEATING APPARATUS

[75] Inventors: Garril J. Paterick-Smith, Orleans; David H. Gerwing, Greely, both of Canada

[73] Assignee: Hovey Industries, Ltd., Gloucester, Canada

[21] Appl. No.: 536,642

[22] Filed: Sep. 29, 1995

[51] Int. Cl.[6] ..... E01B 7/24

[52] U.S. Cl. ..... 246/428; 104/279; 126/271.2 B; 238/29; 238/107

[58] Field of Search ..... 246/428; 104/279; 126/271.2; 237/50, 80; 238/29, 107, 152, 154, 266, 287, 351

[56] References Cited

U.S. PATENT DOCUMENTS

| | | | |
|---|---|---|---|
| 1,802,875 | 4/1931 | Conley . | |
| 2,051,918 | 8/1936 | Thompson, Jr. | 246/428 |
| 2,492,177 | 12/1949 | Olsen | 238/7 |
| 2,704,517 | 8/1955 | De Gracia | 246/428 |
| 3,425,408 | 2/1969 | Vinet | 126/272.1 B |
| 3,536,909 | 10/1970 | Czyl | 246/428 |
| 3,697,746 | 10/1972 | Patterson et al. | 246/428 |
| 4,081,161 | 3/1978 | Upright | 246/428 |
| 4,101,700 | 7/1978 | Ray, Jr. et al. | 428/131 |
| 4,674,718 | 6/1987 | Bjorklund | 246/428 |
| 4,695,017 | 9/1987 | Ringer et al. | 246/428 |

FOREIGN PATENT DOCUMENTS

| | | | |
|---|---|---|---|
| 203267 | 12/1986 | European Pat. Off. | 238/154 |

*Primary Examiner*—S. Joseph Morano

*Attorney, Agent, or Firm*—Dickinson, Wright Moon, Van Dusen & Freeman

[57] ABSTRACT

There is provided a new and useful apparatus for use in a railway switch heating assembly. The apparatus includes a hollow structural member adapted to replace a conventional railway tie and adapted to be connected to a source of heated air, and a mechanism for discharging the heated air from the hollow member to desired locations along the assembly.

13 Claims, 5 Drawing Sheets

RAILWAY SWITCH HEATING APPARATUS

FIELD OF THE INVENTION

This application relates to heating apparatus for railway switch assemblies.

BACKGROUND OF THE INVENTION

It is common in the railway industry in cold climates to use a heating system to control snow and ice build-ups at the switches to ensure that the switches throw properly. It is also common that a switch heater system for this purpose comprises a furnace placed adjacent the switch and duct work for moving the heated air from the furnace to the desired locations along the rails or the switch assembly.

Many of the conventional switch heaters currently in use comprise duct work running from the furnace between a pair of ties and under a near rail to a position between the rails. The heated air is then fed up along the top of the ties parallel to the rails to cover the required distance along the switch rails.

The conventional switch heaters thus described are prone to several significant problems. The energy demand required to successfully melt the ice and snow is extremely high. However, the duct work currently used is typically of simple steel manufacture and consequently, there is tremendous energy lost through the walls of the duct work.

The placement of the duct work between the rails also contributes to significant problems in the switch assembly. It is known to be highly desirable to keep the road bed beneath the switching area in as good condition as possible so as to reduce the impact of the switching process on the wheels of the train, thereby reducing the risk of breakage or derailments. Since the conventional switch heaters heat not only the rails in the area of the switch but also the road bed lying beneath the duct work, a softening effect, commonly referred to as soft-track, occurs on the road bed which can result in significant depressions in the switching area. Also, since the ballast between the ties in the area of the switch must be continually re-tamped with the use of tamping machines, the duct work that is located in that space between the ties must be removed and replaced each time, a task of considerable effort, time and cost.

The area around the switch assembly is prone to a great deal of vibration and movement resulting from the passing of trains. A resulting problem is that the duct work leading from the furnace is often susceptible to undue wear and metal fatigue requiting the duct work to be frequently replaced.

Thus, many of the existing conventional switch heaters produce undesired results which may in some cases severely diminish their advantages and significantly increase the costs of maintaining the switch assembly in proper working condition. Reference is made for example to U.S. Pat. No. 4,081,161 of Upright, issued Mar. 28, 1978 (currently owned by the present applicant); U.S. Pat. No. 3,536,909 of Czyl, issued Oct. 27, 1970; U.S. Pat. No. 2,704,517 of De Garcia (Mengod), issued Mar. 22, 1955; and U.S. Pat. No. 1,802,875 of Conley, issued Apr. 28, 1931.

SUMMARY OF THE INVENTION

In one aspect of the invention there is provided an apparatus for use in the heating of a railway switch assembly. The apparatus comprises a hollow structural member adapted to replace a track supporting member (such as a conventional railway tie) and adapted to be connected to a source of heated air. There is also provided discharge means for distributing the heated air from the hollow structural member to at least one desired location on the assembly.

In a preferred embodiment of the invention, the hollow structural member is insulated.

In another preferred embodiment of the invention, there is provided an insulation assembly between the hollow structural member and the rails.

In yet another preferred embodiment, the source of heated air and the hollow structural member are connected by a flexible connection which permits axial and rotational between the source of heated air and the hollow structural member.

In still another preferred embodiment, the discharge means comprises at least one of a point nozzle or a distribution duct running parallel to and between a pair of rails.

The railway switch heater apparatus of the present invention thus provides a means of heating the switch assembly and the rails. The construction of the hollow structural member is adapted to replace a conventional railway tie and direct heated air from a source to desired points along the switch assembly.

BRIEF DESCRIPTION OF THE DRAWINGS

These and other advantages of the invention will become apparent upon reading the following detailed description and upon referring to the drawings in which.

Figure 1:
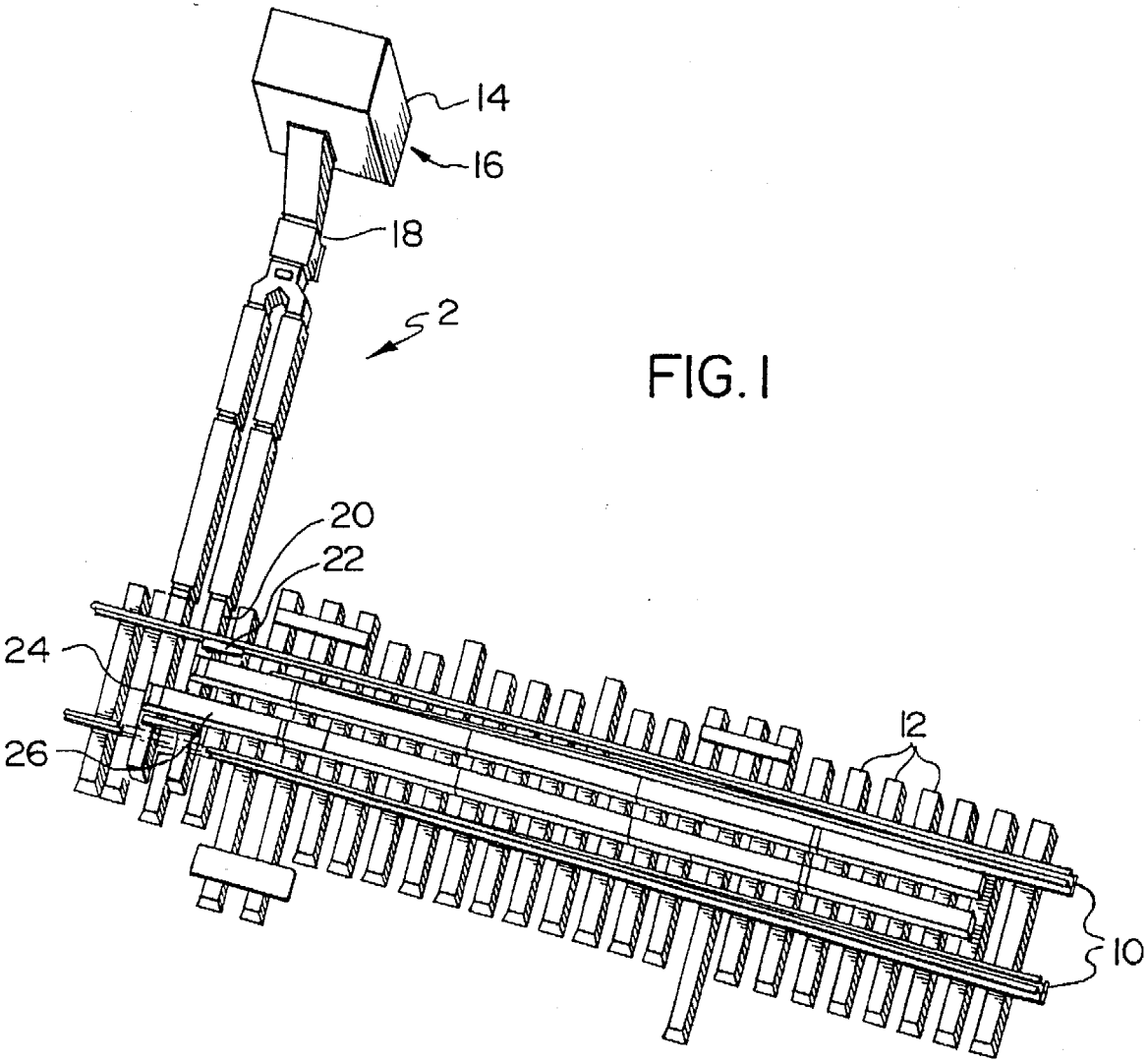
FIG. 1 is a perspective view of the invention in use with a railway switch assembly.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to the drawings, FIG. 1 illustrates a switch heating assembly 2 for use in heating rails 10 mounted on ties 12. The assembly comprises a housing 14 generally containing a propane or natural gas fired furnace 16 (not shown) with supply duct 18. The supply duct 18 is connected to at least one hollow structural member 20 adapted to replace a conventional tie 12 and having discharge nozzle 22 (discussed in more detail below) or an upstanding discharge elbow duct 24 connected to a distribution duct 26 to discharge heated air from the housing 14 to desired points along the assembly 2.

Figure 2:
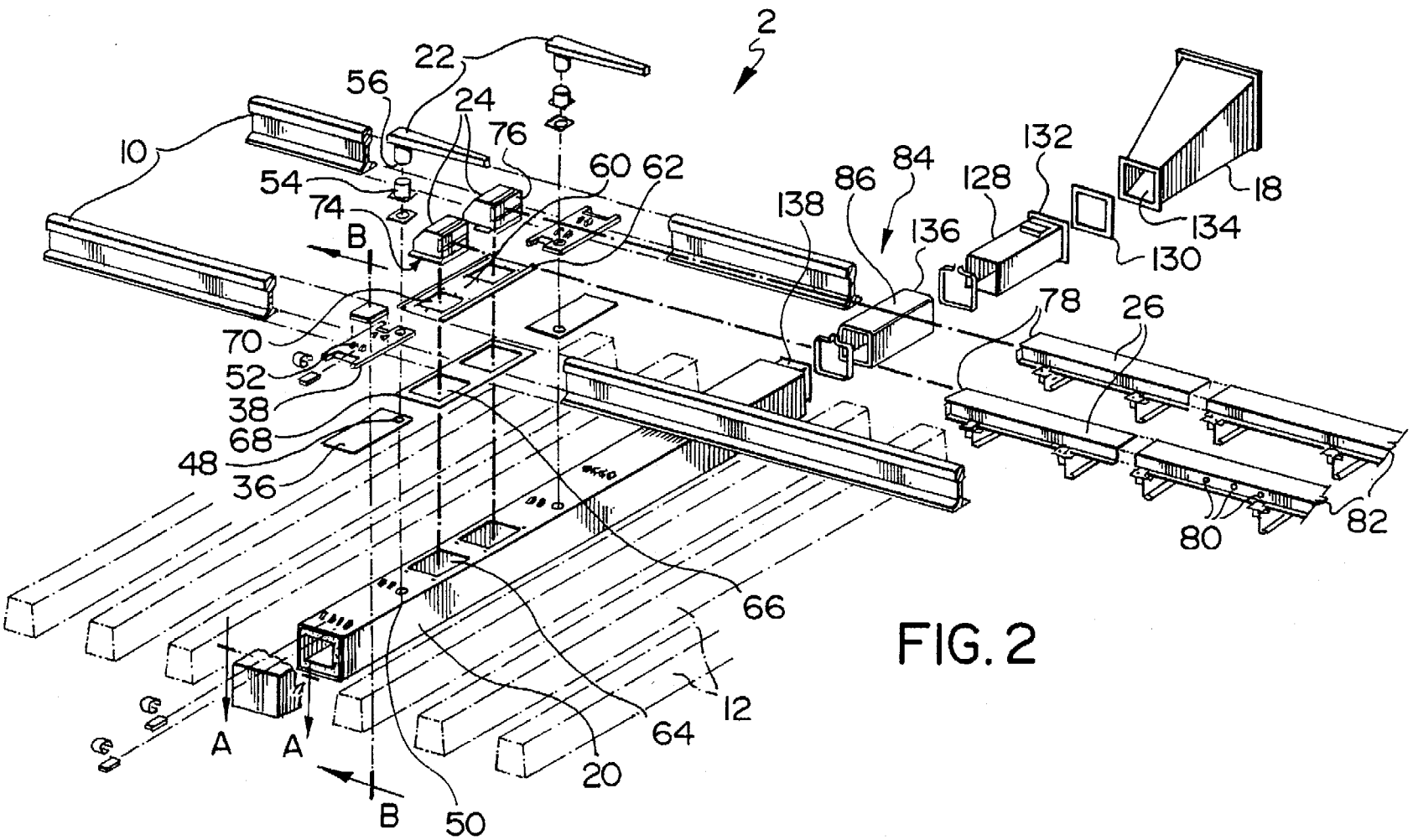
FIG. 2 is an exploded view of the invention having a single hollow structural member.

FIG. 2 shows an exploded view of the switch heating apparatus of the present invention having a single hollow structural member 20. The member 20 is constructed to replace a conventional railway tie 12 and thus support rails 10. The member 20 is connected to a supply duct 18 of a source of heated air 16 (not shown), commonly a propane or natural gas fired furnace. The member is provided with discharge means for transferring the heated air from the source 16 to the rails 10, namely a standard point nozzle 22 and/or an upstanding discharge elbow duct 24 connected to a discharge duct 26 extending parallel to the rails 10.

Figure 3:
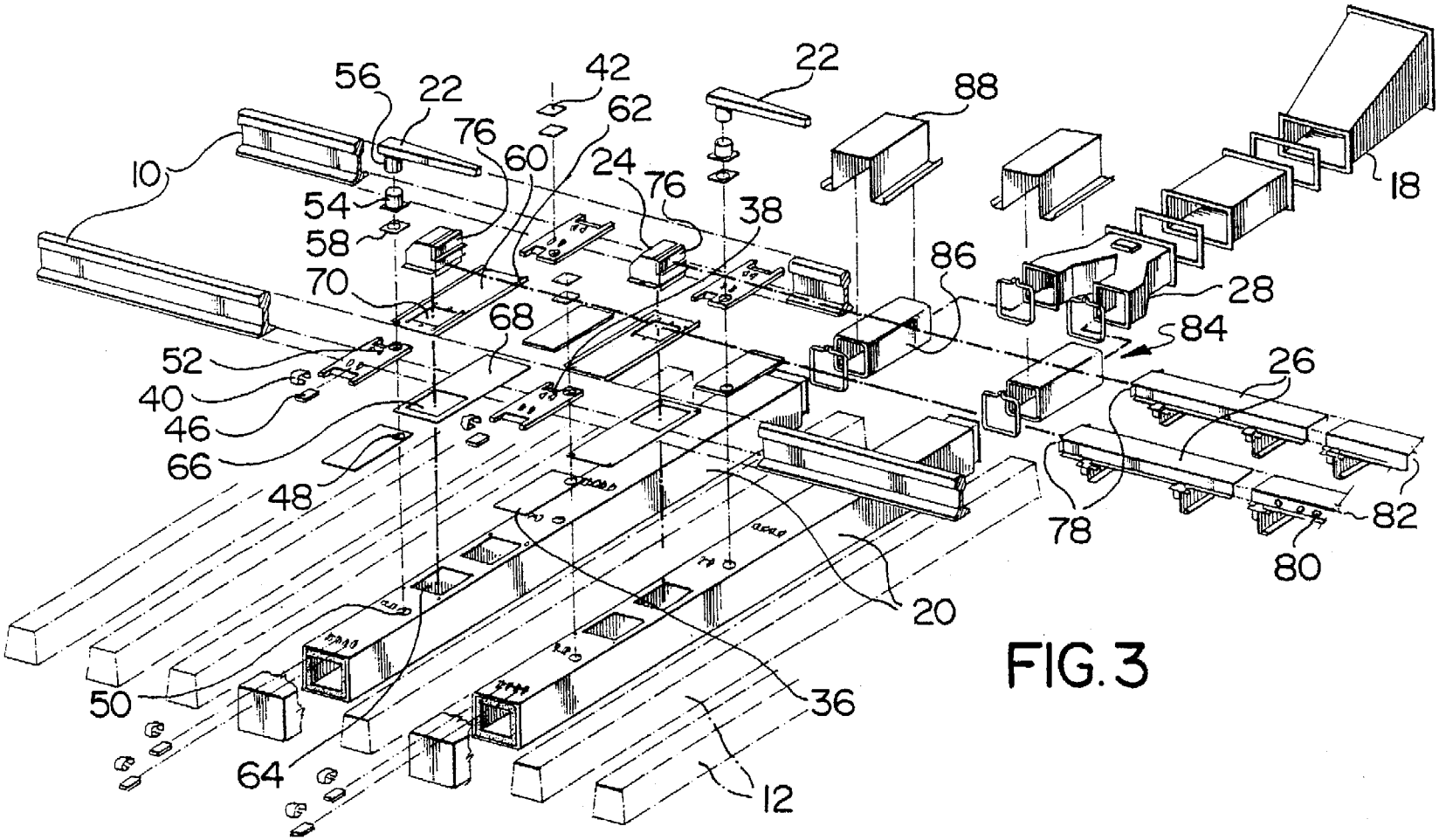
FIG. 3 is an exploded view of the invention having a pair of hollow structural members.

FIG. 3 shows an exploded view of a preferred embodiment of the heating apparatus having a pair of hollow structural members 20, and a Y-shaped duct 28 connecting the members 20 to the supply duct 18.

Figure 4:
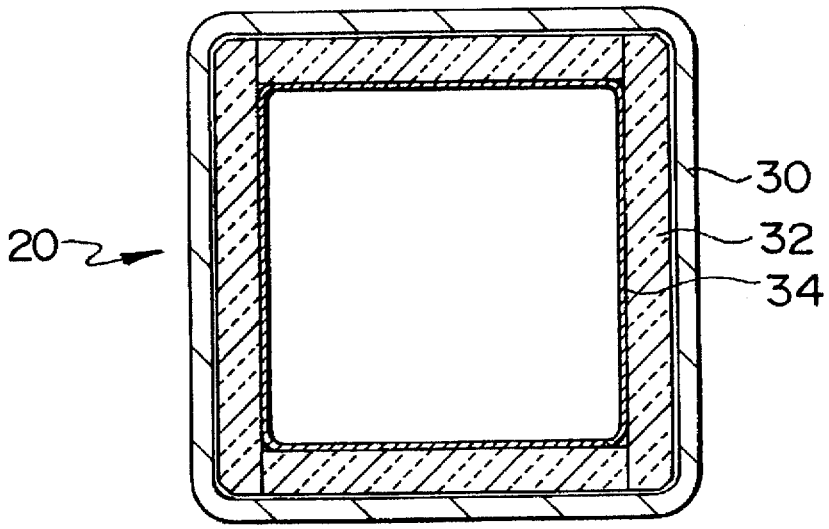
FIG. 4 is a cross-sectional view of the hollow structural member taken along the line A—A of FIG. 2.

The members 20 are preferably thermally insulated along their length. As most clearly illustrated in FIG. 4, the member 20 comprises an outer shell 30, an insulating liner 32 of suitable insulation material, such as Roxul™, and an inner liner 34 of stainless steel.

Figure 5:
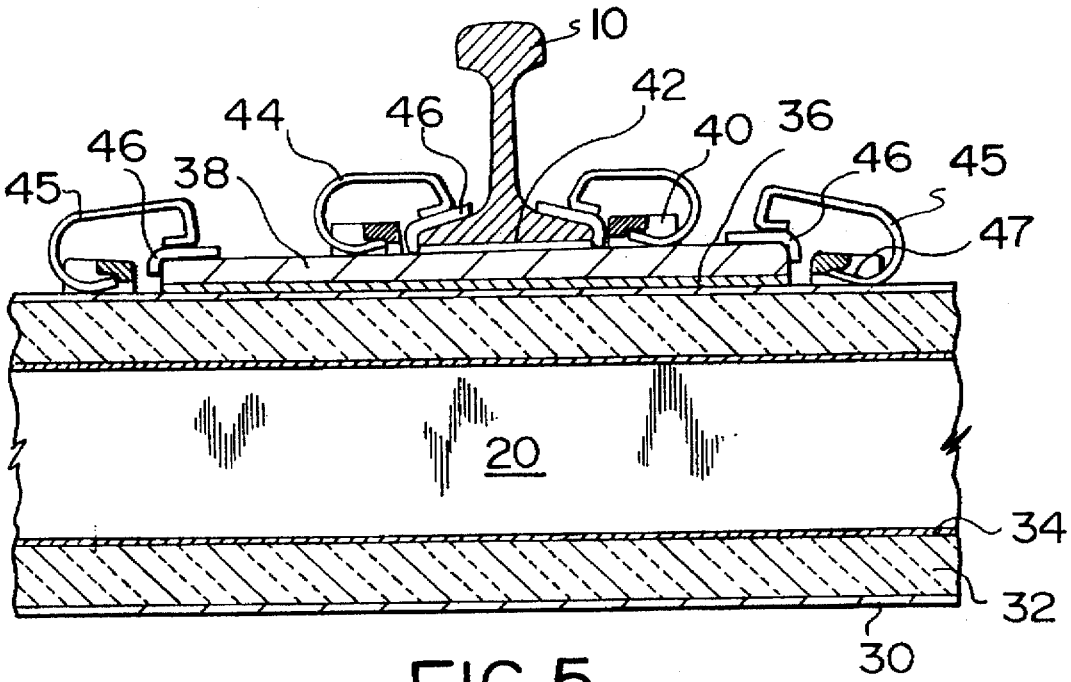
FIG. 5 is a cross-sectional view of the insulating assembly taken along line B—B of FIG. 2.

With reference to FIG. 5, in a preferred embodiment of the invention, the member 20 is electrically and thermally insulated from the rails 10 by a first insulating pad 36, of approximately ¼ inch thickness and constructed of material such as silicone or neoprene, mounted on the member 20; a steel pad 38 of approximately ¾ inch thickness, having a pair of rail shoulders 40 welded thereon; and a second insulating pad 42, of approximately ¼ inch thickness and made of material such as polyurethane. The steel pad 38 is insulated from the member 20 by the first insulating pad 36 and from the rails 10 by the second insulating pad 42. The steel pad may be tapered at 43 to account for banking, or curvature (not shown) in the rails 10. The rail 10 is thus secured to the member 20 by securing the rail clip 44 to the rail 10 and the rail shoulder 40 mounted on the steel pad 38; and by securing the steel pad 38 to the member 20 by the rail clip 45, secured to the shoulder 47, mounted on the member 20. The steel pad 38 is further insulated from the rails 10 by use of rail clip insulator 46, mounted between the rail clips 44 and the rail 10 and between the rail clips 45 and the steel pad 38.

In one embodiment of the invention, as best illustrated in FIGS. 2 and 3, there is provided in the first insulating pad 36, an aperture 48 concentric with an aperture 50 in the member 20, an aperture 52 in the steel pad 38, a nozzle adapter 54 and the inlet portion 56 of nozzle 22. Provided between the steel pad 38 and the nozzle adapter 54 is an adapter insulator 58 to further prevent heat or energy loss from the member 20.

In another embodiment of the invention, the elbow 24 connecting the member 20 to the distribution duct 26 is mounted to the member 20 by means of an adapter plate 60 having downwardly turned flanges 62. The member 20 is provided with an aperture 64 through which heated air may pass. In use, that aperture 64 is placed in mating relation with an aperture 66 on an adapter plate insulator 68, constructed from material such as silicone or neoprene to insulate the adapter plate 60 from the member 20, and an aperture 70 on the adapter plate 60. The heated air may passes from the member 20, through the described apertures to the inlet portion 74 of elbow 24. The heated air is then passed to the outlet portion 76 of the elbow 24 which, in use, is in mating relation with the inlet aperture 78 of the distribution duct 26. The heated air may then be distributed along various points of the assembly 2 by means of a plurality of selectively opened apertures 80 at points along the distribution duct 26. These apertures may be selectively opened during the installation of the apparatus to direct heated air to points along the rails 10 as required by the application. The distribution duct 26 is sealed at opposing end 82.

In a preferred embodiment of the invention, there is a flexible connection, shown generally at 84 connecting the member 20 to the supply duct 18. As illustrated in FIG. 3, this flexible connection may be in the form of a flexible duct 86, constructed of silicone. There is further provided a covering member 88, preferably constructed of galvanised steel, positioned relative to the flexible duct 86 so as to protect it from being damaged by rocks and similar debris displaced by a passing train.

Figure 6:
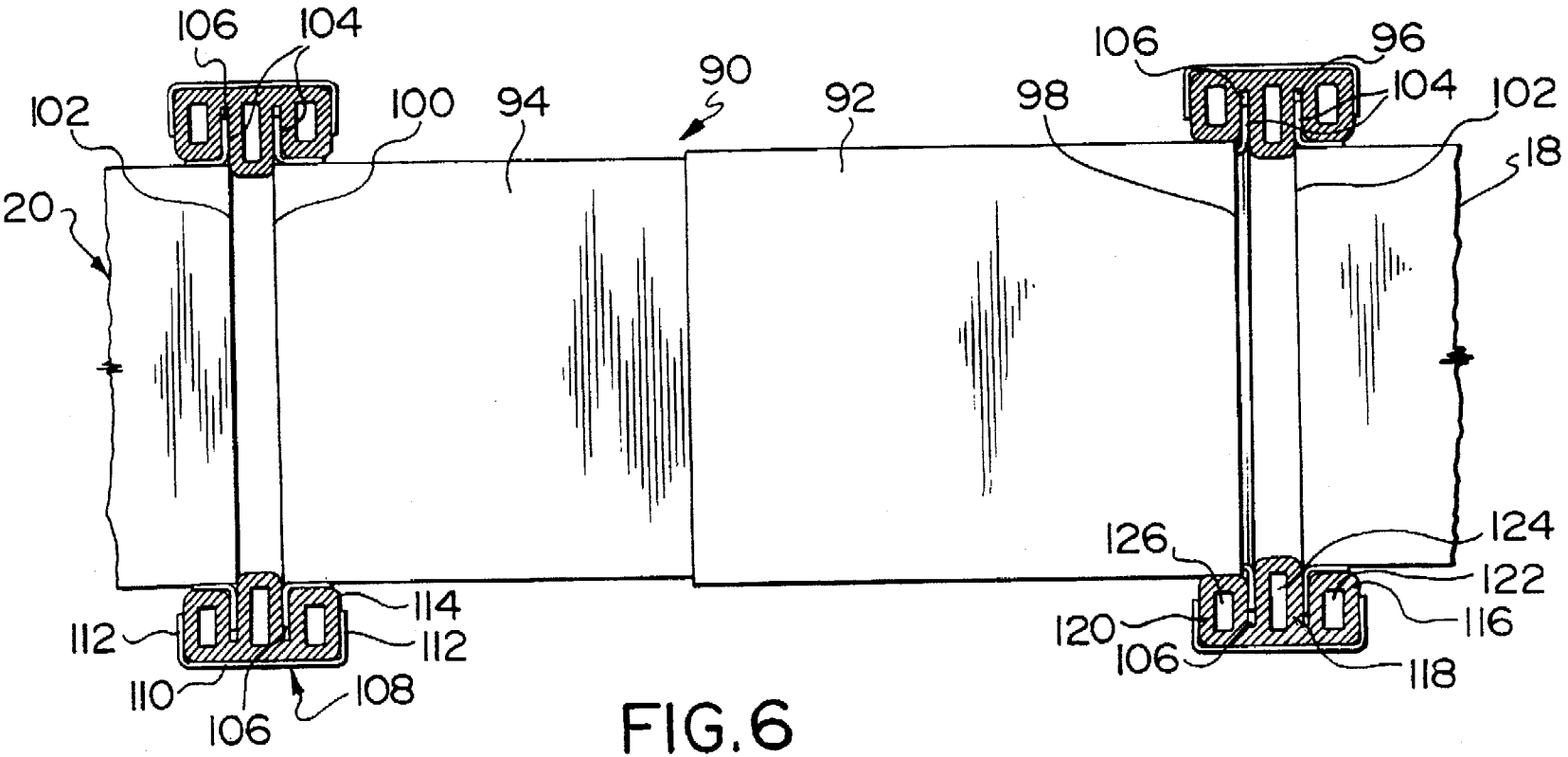
FIG. 6 is a plan view, partly in cross-section, of a preferred embodiment of the flexible connection.

In a most preferred embodiment of the invention, the flexible connection is in the form of a gasket assembly 90, as best illustrated in FIG. 6, which permits rotative and axial movement about the end of the member 20 occasioned by the vibration of a passing train. The gasket assembly 90 comprises a first 92 and second 94 overlapping duct member in slidable and telescoping relation to each other and a flexible gasket 96 mounted respectively between the outer extremities 98 and 100 of the first 92 and second 94 overlapping duct members and the outer extremity 102 of the adjacent member 20 or supply duct 18. The overlapping duct members 92 and 94 are typically constructed of stainless or galvanized steel and the flexible gasket 96 is preferably constructed of silicone.

The outer extremities 98 and 100 of the first 92 and second 94 overlapping duct members respectively and the outer extremity 102 of the adjacent member 20 or supply duct 18 are provided with flanges 104 extending normally from the first 92 and second 94 overlapping duct members and the outer extremity 102 of the adjacent member 20 or supply duct 18 for engagement into the recesses 106 provided in the flexible gasket 96. Positioned around the flexible gasket 96, there is provided a coveting member 108, preferably constructed of stainless steel, having a cross member 110 extending across said gasket and a pair of inwardly turned flanges 112 extending over at least a portion of the exposed lateral surfaces 114 of the gasket 96.

The gasket 96 is comprised of a first portion 116, a second portion 118 and a third portion 120. The first 116 and second 118 portions and the second 118 and third 120 portions are separated by the recesses 106 respectively. Each of the first 116, second 118, and third 120 portions of the gasket 96 is provided with a longitudinal cavity 122, 124, and 126 respectively. The cavities provide stiffness to the gasket 96 while permitting the requisite axial and rotative flexibility of the gasket 96 about the respective abutting member ends. The second portion 118 extends longitudinally between the abutting member ends to fill the gap between the ends when in place within the heating apparatus thus providing a flexible seal between the adjacent member 20 and duct.

As seen in FIG. 2, in an embodiment of the invention, there may be provided an extension duct 128 connecting the member 20 and the supply duct 18, or the flexible connection 84 and the supply duct 18. There is further provided at least one insulating gasket 130 positioned between the abutting end 132 of the extension duct 128 and of the abutting end 134 of the supply duct 18 or, the abutting end 136 of the flexible connection 84 (when the supply duct 18 is not used). A similar gasket may be positioned between abutting ends of any two extension ducts 128 when used.

As demonstrated above, the member 20 is adapted to replace a conventional tie 12, rather than being positioned between a pair of ties 12 as is common in the prior art. This configuration and the insulation of the member 20 along its length thus help prevent the problem of soft-tracking and the need for re-tamping which are prevalent in conventional railway switch heaters while delivering improved control of snow and ice to required points along the switch assembly.

Thus, it is apparent that there has been provided in accordance with the invention an apparatus for use in a railway switch assembly that fury satisfies the objects, aims and advantages set forth above. While the invention has been described in conjunction with example embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. For use in the heating of a railway switch assembly, an apparatus comprising:

a hollow structural member adapted to replace a track supporting member in supporting a pair of rails and adapted to be connected to a source of heated air;

a flexible connection between said structural member and said source of heated air, said flexible connection permitting axial and rotational movement between said structural member and said source of heated air;

discharge means for distributing said heated air from said hollow structural member to at least one desired location on said assembly; and an electrically insulating assembly for inserting between said hollow structural member and rails, said insulating assembly comprising an insulating pad on said hollow structural member, a steel pad resting on said insulating pad, said steel pad provided with at least one rail securing clip with a clip insulating pad deposed between said steel pad and said at least one rail securing clip, and a polyurethane pad resting interposed between said steel pad and said rails.

2. For use in the heating of a railway switch assembly, an apparatus comprising:

a hollow structural member adapted to replace a track supporting member in supporting a pair of rails and adapted to be connected to a source of heated air;

a flexible connection between said structural member and said source of heated air, said flexible connection permitting axial and rotational movement between said structural member and said source of heated air; and discharge means for distributing said heated air from said hollow structural member to at least one desired location on said assembly, wherein said flexible connection comprises first and second overlapping duct members in slidable and telescoping relation to each other and a flexible gasket between the outer extremities of said first and second duct members and adjacent duct members.

3. The apparatus of claim 2 wherein said first and second overlapping duct members are made of stainless steel.

4. The apparatus of claim 2 wherein said rust and second overlapping duct members include a flange in mating relation with the flexible gasket.

5. The apparatus of claim 2 wherein said flexible gasket is made of silicone.

6. The apparatus of claim 2 wherein said flexible gasket includes at least one flange receiving recess.

7. The apparatus of claim 6 wherein said flexible gasket includes two flange receiving recesses.

8. The apparatus of claim 6 wherein said flexible gasket includes at least one longitudinal cavity.

9. The apparatus of claim 6 wherein said flexible gasket includes three longitudinal cavities.

10. The apparatus of claim 6 wherein said flexible gasket comprises two of said flange receiving recesses and three longitudinal cavities.

11. The apparatus of claim 2 including a cover positioned about an outer extremity of said flexible gasket and extending across said gasket.

12. For use in the heating of a railway switch assembly, an apparatus comprising:

a hollow structural member adapted to replace a track supporting member in supporting a pair of rails and adapted to be connected to a source of heated air;

a flexible connection between said structural member and said source of heated air, said flexible connection permitting axial and rotational movement between said structural member and said source of heated air; and discharge means for distributing said heated air from said hollow structural member to at least one desired location on said assembly, wherein the discharge means comprises at least one of a nozzle mounted to an outer surface of said structural member or an elbow duct mounted to an outer surface of said structural member and connected to a distribution duct positioned between said pair of rails in a direction parallel to said rails, wherein the elbow duct is insulated from the structural member by means of an insulating plate constructed of materials from the group consisting of silicone or neoprene.

13. For use in the heating of railway switch assembly, an apparatus comprising:

a hollow structural member adapted to replace a track supporting member in supporting a pair of rails and adapted to be connected to a source of heated air, wherein said hollow structural member comprises an inner liner, an insulating liner and an outer shell along the length of said hollow structural member;

an electrically insulating assembly for inserting between said hollow structural member and said rails, said insulating assembly comprising an insulating pad on said hollow structural member, a steel pad resting on said insulating pad, said steel pad provided with at least one rail securing clip with a clip insulating pad deposed between said steel pad and said at least one rail securing clip, and a polyurethane pad resting interposed between said steel pad and said rails;

a flexible connection between said structural member and said source of heated air, said flexible connection permitting axial and rotational movement between said structural member and said source of heated air, said flexible connection comprising first and second overlapping duct members in slidable and telescoping relation to each other, said first and second overlapping duct members including a flange in mating relation with a flexible gasket between the outer extremities of said first and second duct members and adjacent duct members said flexible gasket comprising two flange receiving recesses and three longitudinal cavities;

discharge means for distributing said heated air from said hollow structural member to at least one desired location on said assembly, said discharge means comprising two nozzles mounted to an outer surface of said hollow structural member and two elbow ducts mounted to an outer surface of said structural member and connected to two distribution ducts positioned between said pair of rails in a direction parallel to said rails.

* * * * *